US008733665B2

(12) United States Patent
Baxter et al.

(10) Patent No.: US 8,733,665 B2
(45) Date of Patent: May 27, 2014

(54) RISER SEGMENT RFID TAG MOUNTING SYSTEM AND METHOD

(75) Inventors: Daniel Brent Baxter, Tomball, TX (US); My-Lan Hiscox, Magnolia, TX (US)

(73) Assignee: Cameron International Corporation, Houston, TX (US)

( * ) Notice: Subject to any disclaimer, the term of this patent is extended or adjusted under 35 U.S.C. 154(b) by 67 days.

(21) Appl. No.: 13/387,612

(22) PCT Filed: Aug. 2, 2010

(86) PCT No.: PCT/US2010/044174

§ 371 (c)(1), (2), (4) Date: Mar. 21, 2012

(87) PCT Pub. No.: WO2011/017280

PCT Pub. Date: Feb. 10, 2011

(65) Prior Publication Data

US 2012/0168519 A1 Jul. 5, 2012

Related U.S. Application Data

(60) Provisional application No. 61/230,732, filed on Aug. 2, 2009.

(51) Int. Cl.
*G06K 19/06* (2006.01)

(52) U.S. Cl.
USPC ..... 235/492

(58) Field of Classification Search
USPC ..... 235/375, 376, 492
See application file for complete search history.

(56) References Cited

U.S. PATENT DOCUMENTS

| | | | | |
|---|---|---|---|---|
| 6,049,279 | A * | 4/2000 | Minarovic | 340/572.8 |
| 2002/0158120 | A1 * | 10/2002 | Zierolf | 235/375 |
| 2008/0128138 | A1 | 6/2008 | Radi | |
| 2009/0121895 | A1 | 5/2009 | Denny et al. | |
| 2009/0205820 | A1 * | 8/2009 | Koederitz et al. | 166/250.01 |

FOREIGN PATENT DOCUMENTS

| | | | |
|---|---|---|---|
| WO | 2005086699 | A2 | 9/2005 |
| WO | 2005100733 | A1 | 10/2005 |

OTHER PUBLICATIONS

International Search Report for PCT/US2010/044174 dated Sep. 29, 2010.

* cited by examiner

*Primary Examiner* — Jamara Franklin
(74) *Attorney, Agent, or Firm* — Chamberlain Hrdlicka

(57) ABSTRACT

A system, in certain embodiments, includes a riser segment including a flange disposed on a longitudinal end of the riser segment. The system also includes a recess disposed within an outer circumferential surface of the flange. The recess extends along an axial direction from a mating surface of the flange. The system further includes a transmitter disposed within the recess.

20 Claims, 5 Drawing Sheets

RISER SEGMENT RFID TAG MOUNTING SYSTEM AND METHOD

CROSS REFERENCE TO RELATED APPLICATION

This application is a 35 U.S.C. §371 national stage application of PCT/US2010/044174 filed Aug. 2, 2010, entitled "Riser Segment RFID Tag Mounting System and Method," which claims priority to U.S. Provisional Patent Application No. 61/230,732, entitled "Riser Segment RFID Tag Mounting System and Method", filed on Aug. 2, 2009, both of which are herein incorporated by reference in their entirety for all purposes.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

As will be appreciated, oil and natural gas have a profound effect on modern economies and societies. Indeed, devices and systems that depend on oil and natural gas are ubiquitous. For instance, oil and natural gas are used for fuel in a wide variety of vehicles, such as cars, airplanes, boats, and the like. Further, oil and natural gas are frequently used to heat homes during winter, to generate electricity, and to manufacture an astonishing array of everyday products.

In order to meet the demand for such natural resources, companies often invest significant amounts of time and money in searching for and extracting oil, natural gas, and other subterranean resources from the earth. Particularly, once a desired resource is discovered below the surface of the earth, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components, such as various casings, valves, fluid conduits, and the like, that control drilling and/or extraction operations.

To extract the resources from a well, a drilling riser may extend from the well to a rig. For example, in a subsea well, the drilling riser may extend from the seafloor up to a rig on the surface of the sea. A typical drilling riser may include a flanged assembly formed from steel, and the drilling riser may perform multiple functions. In addition to transporting drilling fluid into the well, the riser may provide pipes to allow drilling fluids, mud, and cuttings to flow up from the well.

The riser is typically constructed by securing riser segments together via a flanged connection. Specifically, a first riser segment may be lowered from the rig into the sea. A subsequent riser segment may then be secured to the first segment, before lowering the entire stack. In this manner, a riser of a desired length may be formed. Proper tracking and management of riser segments may extend the useful life of each segment. For example, riser segments positioned at greater depths may experience greater stress than riser segments positioned at shallower depths. Consequently, riser segments may be rotated through various depths to evenly distribute the loads across an inventory or riser segments.

Unfortunately, because typical riser segment tracking and management is performed manually, mistakes regarding riser segment deployment may be introduced. Such mistakes may result in decreased riser segment longevity and increased costs.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
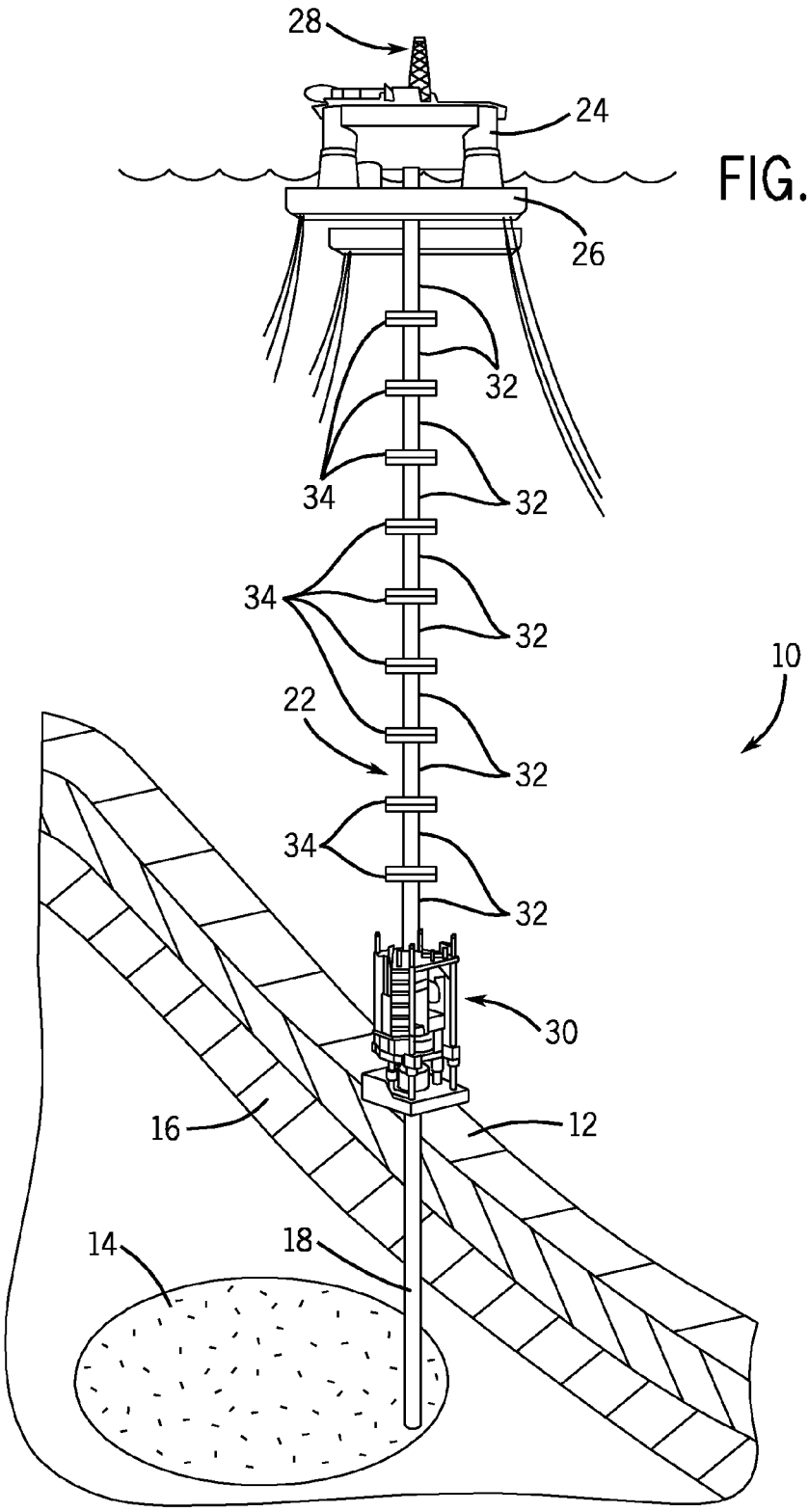
FIG. 1 is a block diagram of a mineral extraction system in accordance with certain embodiments of the present technique.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Embodiments of the present disclosure may facilitate automatic tracking and management of oil and gas equipment, such as tubular segments (e.g., riser segments). As discussed below, embodiments of the present disclosure utilize transmitters and receivers to collect data as components (e.g., coaxial tubular components) pass by one another in a mineral extraction system, such as a subsea mineral extraction system having multiple segments leading toward a well. Although the following discussion refers to riser segments, spiders, and gimbals, the disclosed embodiments may be employed with any tubular components that pass by one another in a coaxial or concentric arrangement, or any other suitable mineral extraction equipment.

In certain embodiments, one or more transmitters may be mounted to each riser segment, while one or more corresponding antennas may be mounted to a spider and/or a gimbal of the rig. As each riser segment is lowered through the spider and gimbal, the antennas may automatically receive or discern a signal from the transmitters identifying the riser segment. In this manner, each riser segment is automatically tracked as it is lowered through a drilling spider and/or gimbal. Such a configuration may substantially reduce or eliminate errors inherent in manual riser segment tracking procedures.

In certain embodiments, each riser segment may include two transmitters embedded within each flange, e.g., a total of four transmitters. The transmitters may be positioned on opposite radial sides of the flange. In certain configurations, each transmitter is a radio frequency identification (RFID) tag configured to communicate with a corresponding RFID antenna. The antennas may be positioned on opposite radial sides of a gimbal bore through which each riser segment passes as it is being lowered into the sea. The position and range of the antennas may be configured to receive a signal from at least one transmitter regardless of riser segment position within the bore. This configuration may ensure that each riser segment is tracked as it passes through the bore, thereby providing accurate tracking and management information.

As discussed in detail below, each RFID tag may be disposed within a recess positioned at an outer radial extent and an outer axial extent of each flange. Consequently, a direct line of sight may be established between the RFID tag and an operator's handheld RFID reader positioned axially outward from the flange. Such a configuration may facilitate tracking and management of riser segments within a warehouse or while in storage on the rig. Furthermore, the position of the recess may establish a direct line of sight between the RFID tag and the antenna disposed within the gimbal of the rig. Such a configuration may facilitate tracking and management of riser segments as they are deployed toward the wellhead. Therefore, by forming a recess within an outer circumferential surface of the flange that extends along the axial direction from a mating surface of the flange, an RFID tag disposed within the recess may communicate with both a handheld reader disposed axial outward from the flange and a fixed antenna disposed radially outward from the riser segment.

FIG. 1 is a block diagram that illustrates an embodiment of a subsea mineral extraction system 10. The illustrated mineral extraction system 10 can be configured to extract various minerals and natural resources, including hydrocarbons (e.g., oil and/or natural gas), or configured to inject substances into the earth. In some embodiments, the mineral extraction system 10 is land-based (e.g., a surface system) or subsea (e.g., a subsea system). As illustrated, the system 10 includes a wellhead 12 coupled to a mineral deposit 14 via a well 16, wherein the well 16 includes a well-bore 18.

The wellhead assembly 12 typically includes multiple components that control and regulate activities and conditions associated with the well 16. For example, the wellhead assembly 12 generally includes bodies, valves and seals that route produced minerals from the mineral deposit 14, provide for regulating pressure in the well 16, and provide for the injection of chemicals into the well-bore 18 (down-hole). In the illustrated embodiment, the wellhead 12 may include a tubing spool, a casing spool, and a hanger (e.g., a tubing hanger or a casing hanger). The system 10 may include other devices that are coupled to the wellhead 12, such as a blowout preventer (BOP) stack 30 and devices that are used to assemble and control various components of the wellhead 12.

A drilling riser 22 may extend from the BOP stack 30 to a rig 24, such as a platform or floating vessel 26. The rig 24 may be positioned above the well 16. The rig 24 may include the components suitable for operation of the mineral extraction system 10, such as pumps, tanks, power equipment, and any other components. The rig 24 may include a derrick 28 to support the drilling riser 22 during running and retrieval, a tension control mechanism, and any other components.

The wellhead assembly may include a blowout preventer (BOP) 30. The BOP 30 may consist of a variety of valves, fittings and controls to block oil, gas, or other fluid from exiting the well in the event of an unintentional release of pressure or an overpressure condition. These valves, fittings, and controls may also be referred to as a "BOP stack."

The drilling riser may carry drilling fluid (e.g., "mud) from the rig 24 to the well 16, and may carry the drilling fluid ("returns"), cuttings, or any other substance, from the well 16 to the rig 24. The drilling riser 22 may include a main line having a large diameter and one or more auxiliary lines. The main line may be connected centrally over the bore (such as coaxially) of the well 16, and may provide a passage from the rig to the well. The auxiliary lines may include choke lines, kill lines, hydraulic lines, glycol injection, mud return, and/or mud boost lines. For example, some of the auxiliary lines may be coupled to the BOP 30 to provide choke and kill functions to the BOP 30.

As described further below, the drilling riser 22 may be formed from numerous "joints" or segments 32 of pipe, coupled together via flanges 34, or any other suitable devices. Additionally, the drilling riser 22 may include flotation devices, clamps, or other devices distributed along the length of the drilling riser 22. As the riser 22 is being assembled, a riser segment 32 is secured to a spider by multiple dogs that engage the flange 34. A subsequent riser segment 32 is then bolted to the riser segment 32 within the spider. The riser 22 is then lowered toward the well, and the next segment 32 is secured to the spider. This process facilitates riser construction by building the riser 22 one segment 32 at a time. The spider is supported by a gimbal that enables the spider rotate relative to the platform 26 as the platform moves with the wind and/or waves.

As discussed in detail below, one or more transmitters (e.g., RFID tags) may be mounted to each riser segment 32. One or more corresponding antennas may be mounted to a spider and/or a gimbal of the rig 24. As each riser segment is lowered through the spider and gimbal, the antennas may automatically receive a signal from the transmitters identifying the riser segment. In this manner, each riser segment 32 is automatically tracked as it is lowered toward the wellhead 12. Such a configuration may substantially reduce or eliminate errors inherent in manually riser segment tracking procedures.

In addition to tracking riser segments 32 during deployment, it may be desirable to identify riser segments 32 within a storage facility. For example, particular riser segments 32 within a warehouse or on the rig 24 may be selected for deployment and/or tagged for maintenance. Such a procedure may involve scanning an RFID tag associated with each riser segment 32 using a handheld RFID reader. Because the riser segments 32 are generally stacked in long rows when in storage, access to the circumference of the flange and/or the body may be limited. Consequently, in the present embodiment, an RFID tag is mounted within each riser segment 32 such that it may be read from both the longitudinal end of the segment 32 and the outer circumference of the flange 34.

In certain embodiments, a recess is disposed within an outer circumferential surface of the flange 34. The recess extends along the axial direction from a mating surface of the flange 34. In this manner, a handheld RFID reader positioned adjacent to the recess and axial outward from the mating surface may communicate with an RFID tag disposed within the recess. Furthermore, a fixed RFID antenna disposed within the gimbal or spider, and positioned radially outward from the recess, may communicate with the same RFID tag. In other words, the RFID tag transmits a signal in both the axial direction away from the mating surface of the flange 34, and the radial direction away from the outer circumferential surface of the flange 34. In this manner, a single RFID tag may be read by both a handheld RFID reader when the riser segment 32 is in storage, and a fixed RFID antenna when the riser segment 32 is being lowered into the sea. Such a configuration may reduce costs compared to embedding two RFID tags within a riser segment 32, one for communicating with the handheld reader and another for communicating with the fixed antenna.

Figure 2:
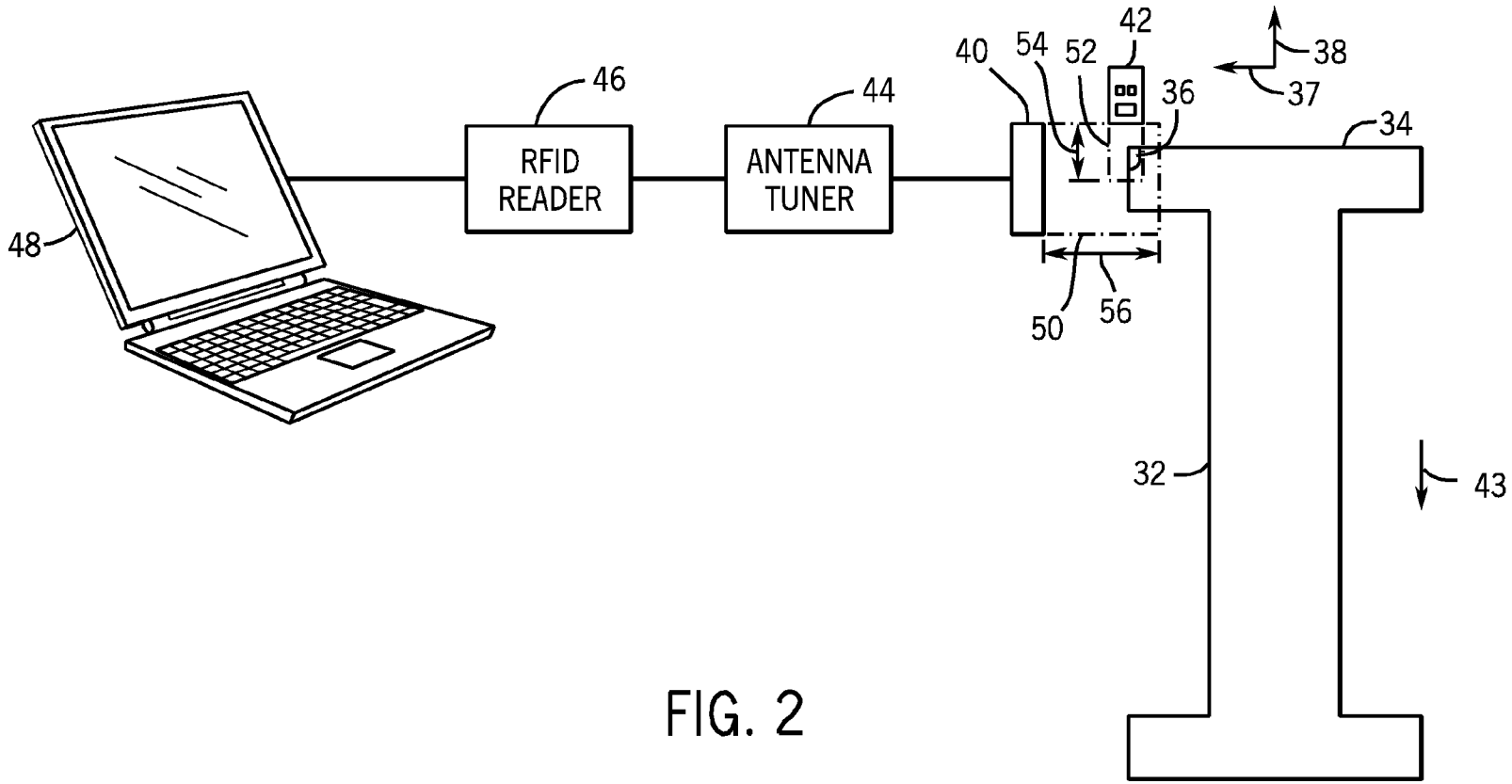
FIG. 2 is a block diagram of a system configured to receive information from a transmitter embedded within a riser segment in accordance with certain embodiments of the present technique.

FIG. 2 is a block diagram of a system configured to receive information from a transmitter embedded within a riser segment 32. As illustrated, an RFID tag 36 is coupled to the flange 34 of the riser segment 32. As discussed in detail below, the RFID tag 36 is disposed within a recess positioned at an outer radial extent (i.e., along the radial direction 37) and an outer axial extent (i.e., along the axial direction 38) of the flange 34. In this position, the RFID tag 36 may communicate with a fixed RFID antenna 40 disposed within a gimbal or spider of the rig 24, and a handheld RFID reader 42 offset from the RFID tag 36 along the axial direction 38. In this configuration, the riser segment 32 may be tracked as it passes through the gimbal and spider in the direction 43, and while in storage.

Both the RFID antenna 40 and the handheld reader 42 may automatically read identification information from the RFID tag 36. In this manner, each riser segment 32 may be tracked as it is deployed and while in storage, thereby providing accurate tracking and management information. As will be appreciated, the RFID tags 36 may also be coupled to other components within the mineral extraction system 10, such as the BOP 30, components of the derrick 28, etc.

In the present embodiment, each riser segment 32 includes one or more RFID tags 36 configured to communicate with the antenna 40 and the handheld reader 42. While RFID tags 36 are referred to below, it will be appreciated that alternative embodiments may employ other transmitter configurations. In one embodiment, two RFID tags 36 are positioned approximately 180 degrees apart about the circumference of the flange 34. In further embodiments, more or fewer tags 36 may be positioned along the circumference of the flange 34. For example, certain riser segment flanges 34 may include 1, 2, 3, 4, 5, 6, 7, 8, 9, 10, or more tags 36 positioned about the circumference. Further embodiments may include RFID tags 36 disposed within both flanges 34 of each riser segment 32.

As will be appreciated, RFID tags 36 include an antenna and a circuit. The antenna is both a receiving antenna and a transmitting antenna, designed to resonate at a particular frequency. Electrical energy is transferred from the antenna 40 or the handheld reader 42 to the RFID tag 36 via a power/interrogation signal (electrical or magnetic coupling) which is received by the RFID tag antenna and serves to power the circuit. As discussed in detail below, the circuit holds a small amount of coded information, such as identification data, manufacture date, part number, etc. Certain embodiments employ a "passive" circuit which does not have an independent power source and does not initiate transfer of information except in response to the signal from the antenna 40 or the handheld reader 42. The power/interrogation signal from the antenna 40 or handheld reader 42 will power the circuit and cause the circuit to generate a control signal encoded with the data stored in the circuit.

In the present configuration, the antenna 40 is electrically coupled to an antenna tuner 44. As will be appreciated by those skilled in the art, to transfer energy from the antenna 40 to the RFID tag 36 efficiently, the antenna 40 may be tuned to the resonant frequency of the RFID tag 36. Specifically, the inductance of the antenna 40 may be selected to match the inductance of the RFID tag 36, and to enhance energy transfer efficiency within the largely metallic environment. Therefore, the antenna tuner 44 alters electromagnetic properties of the antenna 40 to properly communicate with the RFID tag 36.

As illustrated, the antenna tuner 44 is electrically coupled to an RFID reader 46. The RFID reader 46 both provides the power/interrogation signal to the antenna 40, and receives RFID tag information from the antenna 40. For example, in certain configurations, each RFID tag 36 is encoded with a unique identification number. When the RFID tag 36 receives the power/interrogation signal, the tag 36 may transmit a reply signal indicative of the unique identification number. The RFID reader 46 may then convert this signal into a digital representation of the unique identification number for the particular RFID tag 36. As discussed in detail below, the tag identification number may serve to uniquely identify a particular riser segment 32.

As illustrated, the RFID reader 46 is communicatively coupled to a data processing unit, such as the illustrated computer 48. The computer 48 is configured to receive tag identification data from the RFID tag 36 to uniquely identify a particular riser 32.

The handheld reader 42 may contain similar components to those described above with regard to the antenna 40 (i.e., antenna tuner, RFID reader, and data processing unit). However, as will be appreciated, due to the smaller size of the handheld reader 42, the range may be limited compared to the antenna 40. Specifically, the handheld reader 42 may employ a smaller antenna and a less powerful RFID reader. Therefore, a read range 50 of the antenna 40 may be larger than a reader range 52 of the handheld RFID reader 42. The read ranges 50 and 52 define a range in which the antenna 40 or the handheld reader 42 will be able to receive a signal from the RFID tag 36. As will be appreciated, the antenna 40 may be able to read data from RFID tags 36 outside of the range 50, and the handheld reader 42 may be able to read data from RFID tags 36 outside of the range 52. However, the read ranges 50 and 52 illustrate the minimum distance the antenna 40 or handheld reader 42 will be able to receive RFID data from the tag 36.

As will be appreciated, the radial and axial extent of each read range 50 and 52 is defined by the antenna configuration and the frequency at which the antenna 40, handheld reader 42 and RFID tags 36 operate, among other factors. As illustrated, the read range 50 extends along the radial direction 37 a distance 56, while the read range 52 extends along the axial direction 38 a distance 54. In certain embodiments, the distance 56 may be approximately between 1 to 12, 4 to 10, 6 to 9, or about 9 inches. In contrast, the distance 54 may be approximately between 0.5 to 4, 1 to 3, or about 2 inches. Consequently, an operator using the handheld reader 42 may position the reader 42 closer to the flange 34 than the distance the antenna 40 is mounted away from the flange 34. Providing an extended read range 50 for the antenna 40 may facilitate reading the RFID tag 36 regardless of riser segment position within the gimbal and spider.

As previously discussed, each RFID tag 36 contains a circuit which stores a unique identification number. For example, in the present embodiment, each RFID tag 36 includes a 64 bit identification number. As will be appreciated, more than $18\times10^{18}$ possible identification numbers exist within a set of 64 bit numbers. Therefore, there is effectively no limit to the number of RFID tags 36 that may be employed in the present configuration. In alternative embodiments, 16 bit, 32 bit, 128 bit, or more, identification numbers may be utilized. The computer 48 and/or the handheld reader 42 may include a table that associates the tag identification number with a particular riser segment 32. As will be appreciated, every riser segment 32 (or other component including an RFID tag 36) within an inventory may be included within the table.

In the present embodiment, the antenna 40 and the handheld RFID reader 42 are configured to communicate with low frequency RFID tags 36. As will be appreciated, RFID tags 36 may transmit within a variety of frequency ranges. For example, RFID tags 36 that operate within a frequency range of approximately between 30 to 300 kHz are generally considered low frequency, RFID tags 36 that operate within a frequency range of approximately between 3 to 30 MHz are generally considered high frequency, and RFID tags 36 that operate within a frequency range of approximately between 0.3 to 3 GHz are generally considered ultra high frequency.

Each operating frequency has particular advantages and disadvantages. Specifically, low frequency RFID tags (i.e., tags operating at a frequency approximately between 30 to 300 kHz) have the ability to transmit through materials that would block high frequency and/or ultra high frequency transmissions. In the present application, an RFID tag 36 may be secured to the riser segment 32 prior to priming and painting the segment 32. Therefore, the RFID tag 36 may be coated with one or more layers of primer and paint. Such coatings may interfere within high frequency and/or ultra high frequency transmissions. Furthermore, the riser segments 32 are exposed to various contaminants on the rig 24. For example, drilling mud, grease, or other material may build up on the riser segments 32 and the RFID tags 36. Such materials may further interfere with high frequency and/or ultra high frequency transmissions. Consequently, the present embodiment may employ low frequency RFID tags 36 which emit a signal that may penetrate the primer, paint, drilling mud, grease, or other materials. For example, the present embodiment may employ RFID tags 36 that operate within a frequency range of approximately between 30 to 300, 50 to 250, 75 to 200, 100 to 150, or about 125 kHz. Such frequency ranges may be particularly suited for the drilling environment.

Figure 3:
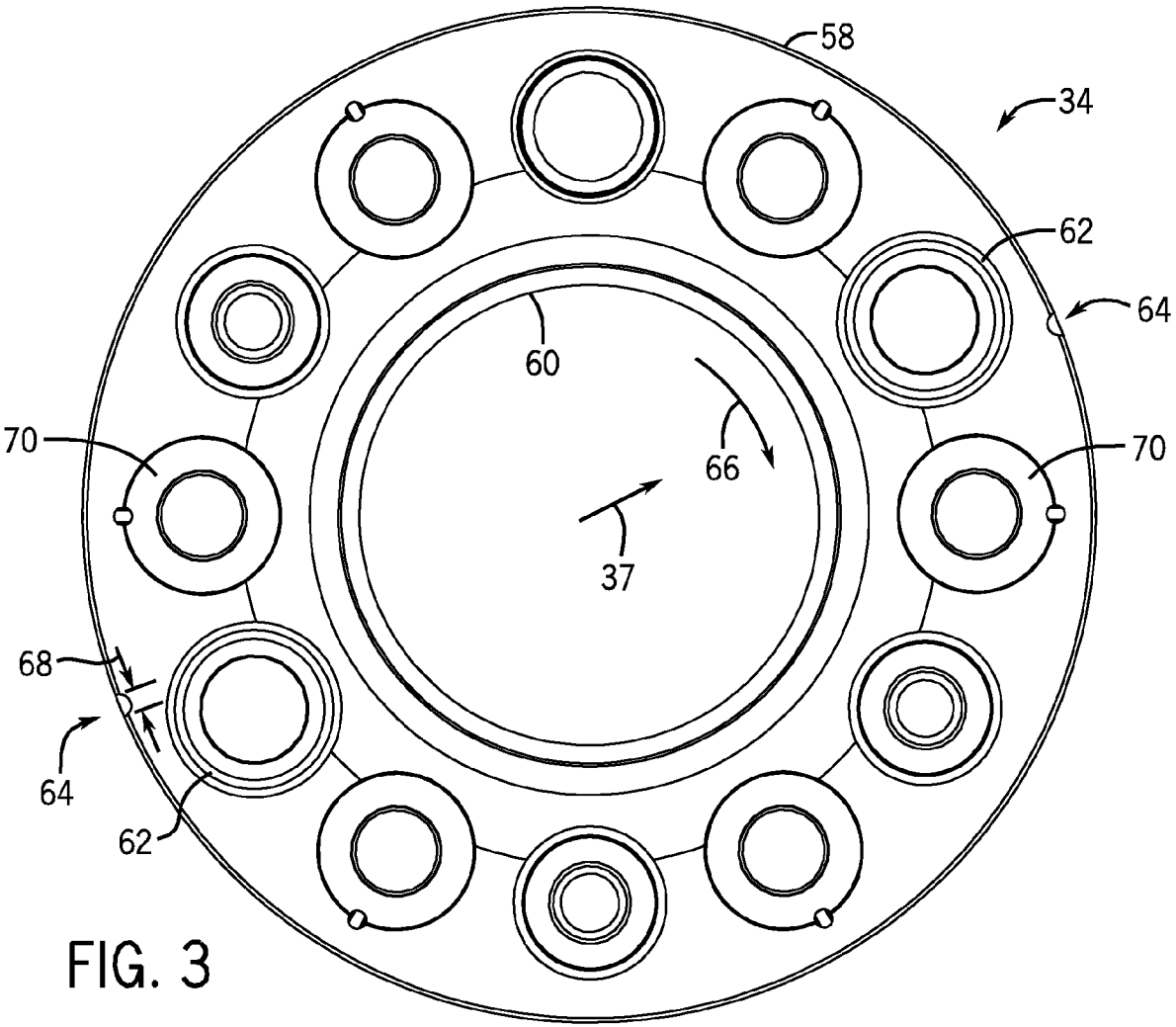
FIG. 3 is a top view of a riser segment flange including two transmitter recesses in accordance with certain embodiments of the present technique.

FIG. 3 is a top view of a riser segment flange 34 including two transmitter recesses 64 disposed approximately 180 degrees apart along a circumferential direction 66. As illustrated, the flange 34 includes an outer casing 58, a main line 60, and auxiliary lines 62. A diameter of the main line 60 is larger than a diameter of each auxiliary line 62. The main line 60 may establish a passage from the rig to the well for providing tools, drilling fluids (e.g., mud), or any other substance or device during operation of the mineral extraction system 10. The auxiliary lines 62 may include choke lines, kill lines, hydraulic lines, glycol injection, mud return, and/or mud boost lines. For example, some of the auxiliary lines 62 may be coupled to the BOP 30 to provide choke and kill functions to the BOP 30.

As will be appreciated, the top view of the riser segment flange 34 shown in FIG. 3 represents the portion of the riser segment 32 visible to an operator when the riser segment 32 is in storage. Specifically, the riser segments 32 are generally stored in rows, and stacked on top of one another. In this configuration, the only portion of the riser segment 32 accessible by the operator is the outer axial surface of the flange 34. As illustrated, the recesses 64 extend from the outer axial surface of the flange 34, thereby establishing an opening in the flange 34 facing the operator. Consequently, a direct line of sight may be established between an RFID tag 36 disposed within the recess 64 and the operator's handheld RFID reader 42. Such a configuration may facilitate tracking and management of riser segments 32 within a warehouse or while in storage on the rig 24.

As illustrated, each recess 64 has a diameter 68 that extends along the circumferential direction 66. The diameter 68 may be selected to accommodate the dimensions of the RFID tag 36. For example, in certain embodiments, the diameter 68 may be approximately 1, 2, 3, 4, 5, 6, 7, or more eighths of an inch. Furthermore, it will be appreciated that the particular circumferential position of each recess 64 may be selected based on a structural analysis of the riser flange 34. In the present embodiment, each recess 64 is positioned at a circumferential location that significantly reduces the increased stress associated with providing a recess 64 in the flange 34. Specifically, each recess 64 is offset from bolt holes 70 in the circumferential direction 66. Furthermore, the recesses 64 are positioned circumferentially outward from the center of each auxiliary line 62 to reduce the stress on the flange 34 adjacent to the auxiliary lines 62. In this configuration, the recesses 64 may be machined or drilled into the flange 34 without significantly affecting the structural integrity of the flange 34. As discussed in detail below, such a configuration facilitates mounting RFID tags 36 to existing flanges 34 without extensive modification.

Figure 4:
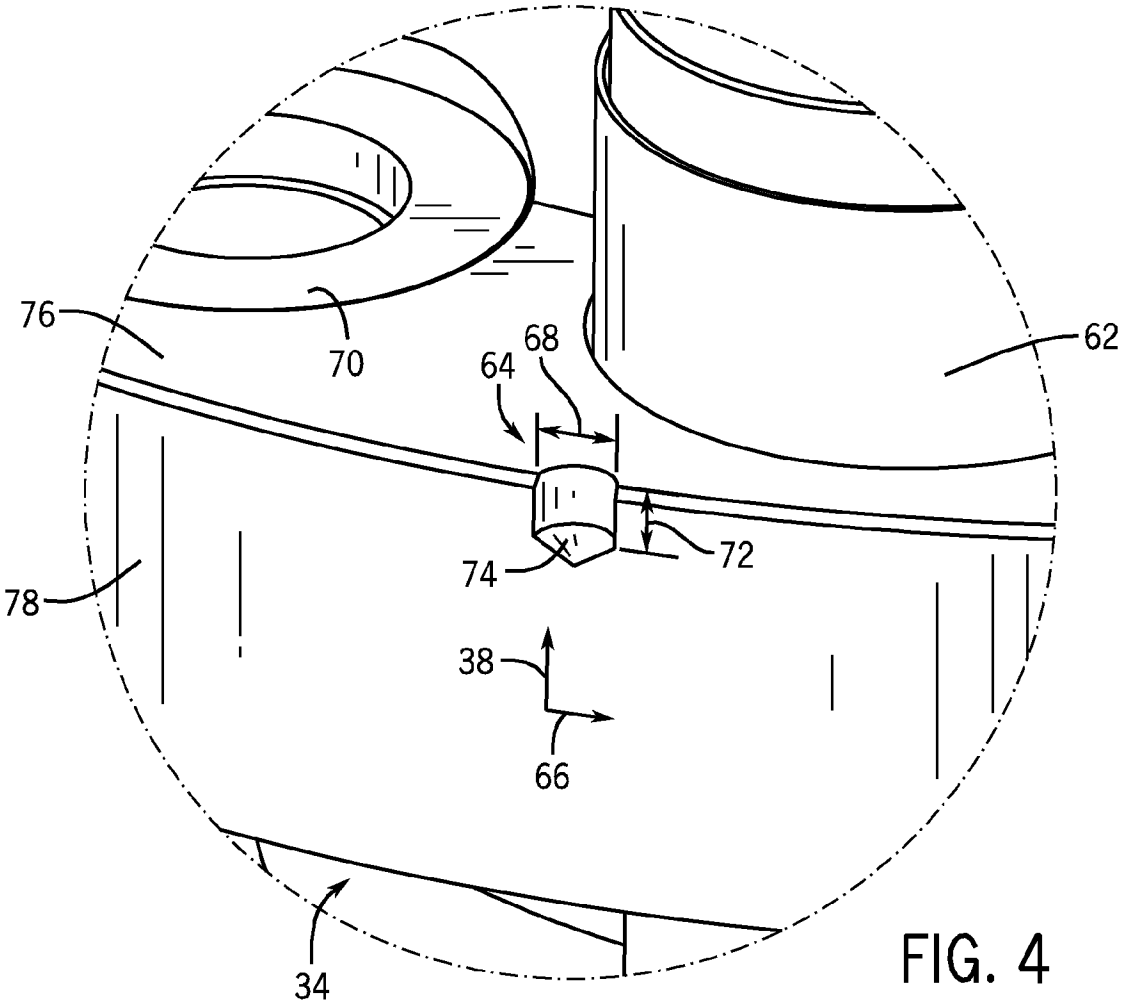
FIG. 4 is a perspective view of a recess, as shown in FIG. 3, in accordance with certain embodiments of the present technique.

FIG. 4 is a perspective view of one recess 64, as shown in FIG. 3, configured to contain an RFID tag 36. As previously discussed, each recess 64 has a diameter 68 extending along the circumferential direction 66. Furthermore, as illustrated, the recess 64 has a height 72 extending along the axial direction 38. As will be appreciated, the height 72 may be selected to accommodate the dimensions of the RFID tag 36. For example, the height 72 may be approximately 0.5, 0.75, 1, 1.25, 1.5, 1.75, 2, or more inches. As illustrated, the recess 64 also includes a conical base 74 configured to accommodate the shape of certain RFID tags 36.

As previously discussed, the riser segments 32 are configured to be secured together via the flanges 34 to form the riser 22. Consequently, the outer axial surface of the flange 34 corresponds to a mating surface 76. As previously discussed, the recess 64 is configured to establish an opening in the mating surface 76 such that an operator may scan the RFID tag 36 with the handheld RFID reader 42. Furthermore, because the recess 64 is disposed at the outer radial extent of the flange 34, the recess 64 forms an opening within an outer circumferential surface 78. This opening establishes a direct line of sight between the RFID tag 36 disposed within the recess 64 and the antenna 40 disposed within the gimbal or spider of the rig 24. Such a configuration may facilitate tracking and management of riser segments 32 as they are deployed toward the wellhead 12. Therefore, by forming a recess 64 within the outer circumferential surface 78 that extends along the axial direction 38 from the mating surface 76, an RFID tag 36 disposed within the recess 64 may communicate with both a handheld reader 42 disposed axial outward from the flange 34 and a fixed antenna 40 disposed radially outward from the riser segment 32.

As previously discussed, the recess 64 may be precisely positioned to maintain the structural integrity of the flange 34. Furthermore, the dimensions 68 and 72 of the recess 64 may be precisely machined or drilled such that the RFID tag 36 mounts substantially flush with the mating surface 76 and the outer circumferential surface 78. The recess 64 may either be machined during the riser segment manufacturing process, or drilled into an existing riser flange 34 as a retrofitting operation. As will be appreciated, during the manufacturing process, the recess 64 may be machined as part of the flange machining process. In this manner, the position and dimensions of the recess 64 may be precisely formed. Alternatively, the recess 64 may be drilled into an existing flange 34 using a specialized drilling rig. In certain configurations, the drilling rig may be connected to one bolt hole 70, and configured to rotate about another bolt hole 70. Because the positions of the bolt holes 70 are precisely located within the flange 34, the position and dimensions of the recess 64 may be precisely formed. In certain embodiments, the drilling rig may include a magnetic drill, configured to secure to the flange 34 by a magnetic connection.

Figure 5:
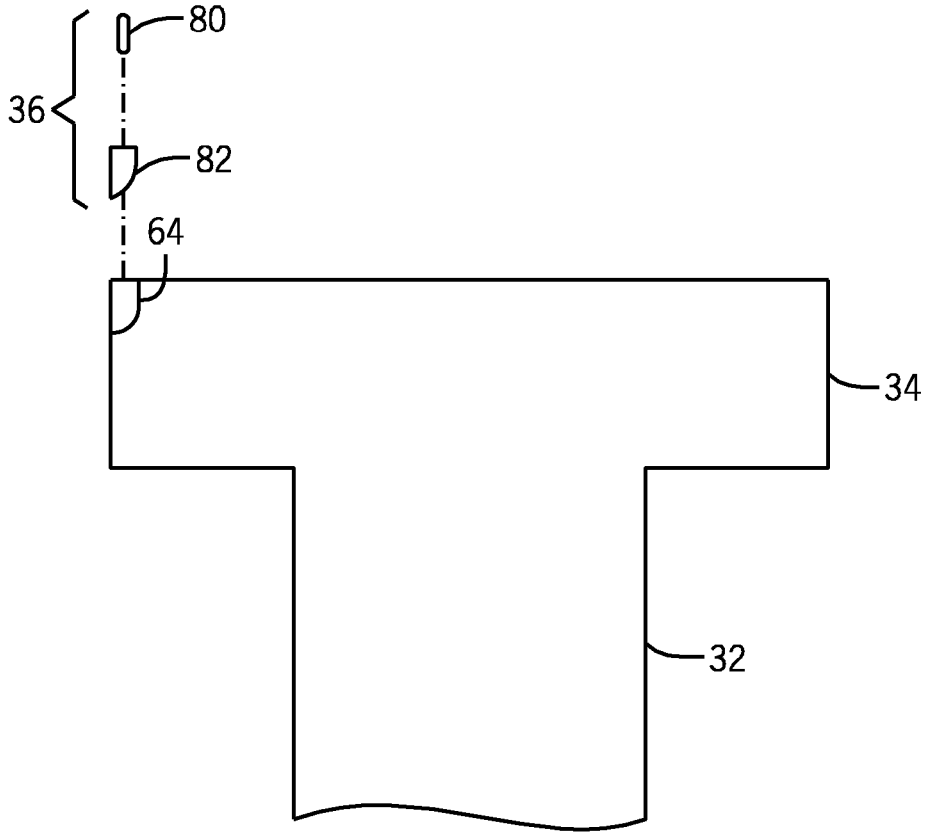
FIG. 5 is a block diagram of a transmitter that may be disposed within the recess of FIG. 4 in accordance with certain embodiments of the present technique.

FIG. 5 is a block diagram of an RFID tag 36 that may be disposed within the recess 64 of FIG. 4. As illustrated, the RFID tag 36 may include a transmitter or transponder 80 and a protective housing 82. In certain embodiments, the transponder 80 is a "glass transponder" that includes an RFID antenna and corresponding circuitry housed within an airtight glass casing. In the present configuration, the transponder 80 is capsule-shaped. However, as will be appreciated, the shape of the transponder 80 may vary in alternative embodiments. In certain configurations, the housing 82 includes an inner surface contoured to match the shape of the transponder 80, and an outer surface contoured to match the shape of the recess 64. In this manner, the protective housing 82 may serve to properly secure the transponder 80 within the recess 64. For example, the transponder 80 may be secured within the protective housing 82 by an adhesive connection. Furthermore, the protective housing 82 may be secured within the recess 64 by a second adhesive connection. As will be appreciated, a liquid resin, such as polyester, vinylester, epoxy, etc., may be employed in certain embodiments. The protective housing 82 may be molded from a thermoplastic, such as ABS, acrylic, PEEK, polyester, or other suitable thermoplastic. The protective housing 82 is configured to protect the transponder 80 from high water pressure, extreme temperatures and/or excessive loads, thereby extending the useful life of the transponder 80.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system comprising:

a mineral extraction component including a flange disposed on a longitudinal end of the mineral extraction component;

a first recess extending from an outer circumferential surface of the flange and from a mating surface of the flange; and a first transmitter disposed within the first recess.

2. The system of claim 1, comprising:

a second recess disposed within the outer circumferential surface of the flange approximately 180 degrees circumferentially offset from the first recess, wherein the second recess extends along the axial direction from the mating surface of the flange; and a second transmitter disposed within the second recess.

3. The system of claim 1, wherein the first transmitter is a radio frequency identification (RFID) tag.

4. The system of claim 1, wherein the first transmitter is configured to operate within a frequency range of approximately 30 to 300 kHz.

5. The system of claim 1, wherein the first transmitter is secured within the first recess by an adhesive connection.

6. The system of claim 1, wherein the first transmitter is disposed within a protective housing, and the protective housing is secured within the first recess.

7. The system of claim 6, wherein the first transmitter is secured within the protective housing by an adhesive connection, and the protective housing is secured within the first recess by an adhesive connection.

8. The system of claim 6, wherein an inner surface of the protective housing is contoured to match a shape of the first transmitter, and an outer surface of the protective housing is contoured to match a shape of the first recess.

9. A method for mounting a transmitter within a flange of a riser segment, comprising:

forming a recess extending from an outer circumferential surface of the flange and from a mating surface of the flange; and disposing a transmitter within the recess.

10. The method of claim 9, wherein the step of forming the recess is performed during a flange manufacturing process.

11. The method of claim 9, wherein the step of forming the recess is performed as a retrofitting operation.

12. The method of claim 11, wherein forming the recess comprises drilling a hole into the flange with a magnetic drill.

13. The method of claim 9, wherein disposing the transmitter within the recess comprises securing the transmitter to the recess with an adhesive connection.

14. The method of claim 9, wherein the transmitter comprises a radio frequency identification (RFID) tag.

15. A system, comprising:

a recess disposed within a flange of a riser segment; and a transmitter disposed within the recess, wherein the transmitter includes a longitudinal end positioned substantially flush with a mating surface of the flange, and a circumferential surface positioned substantially flush with an outer circumferential surface of the flange.

16. The system of claim 15, comprising a receiver configured to communicate with the transmitter, wherein the receiver is positioned radially outward from the recess.

17. The system of claim 15, comprising a receiver configured to communicate with the transmitter, wherein the receiver is positioned axially outward from the recess.

18. The system of claim 15, wherein the transmitter comprises a radio frequency identification (RFID) tag.

19. The system of claim 15, wherein the transmitter is configured to operate within a frequency range of approximately 30 to 300 kHz.

20. The system of claim 15, wherein the transmitter is secured to the recess by an adhesive connection.

* * * * *